US005692257A

United States Patent [19]

Albertieri

[11] Patent Number: 5,692,257

[45] Date of Patent: Dec. 2, 1997

[54] COMBINATION BABY BLANKET, BUNTING AND BAG

[76] Inventor: Liz Albertieri, 13 Deepdale Pkwy., Albertson, N.Y. 11507

[21] Appl. No.: 533,440

[22] Filed: Sep. 25, 1995

[51] Int. Cl.[6] ..... A47C 9/00; A47G 9/00

[52] U.S. Cl. ..... 5/655; 5/413; 5/494; 5/502

[58] Field of Search ..... 5/413, 417, 420, 5/485, 494, 502, 655; 2/69, 69.5

[56] References Cited

U.S. PATENT DOCUMENTS

| | | | |
|---|---|---|---|
| D. 269,658 | 7/1983 | Bor | 5/655 |
| 872,122 | 2/1907 | Guild | 5/413 |
| 1,373,378 | 3/1921 | Backmann | 2/69 |
| 2,358,410 | 10/1944 | Matthesius | 5/413 |
| 3,034,132 | 9/1962 | Landsberger et al. | 5/413 |
| 4,154,323 | 5/1979 | Sneider | 5/417 |
| 4,886,150 | 12/1989 | Fitzsimmons | 5/420 |
| 5,048,975 | 9/1991 | Holbrook | 5/420 |

*Primary Examiner*—Rodney M. Lindsey
*Assistant Examiner*—Fredrick Conley
*Attorney, Agent, or Firm*—Collard & Roe, P.C.

[57] ABSTRACT

A baby blanket foldable to form a bunting and a bag including a soft cloth panel having a left edge a spaced opposite right edge. The cloth panel includes an upper, middle and lower section, which each extend from the left edge to the right edge. Left and right panels are pivotally connected to the left and right edges, respectively. The cloth panel is spread out with the left and right panels extending to form a large, soft baby blanket or changing cloth. The lower section is folded over and secured to the middle section along the edges to define a baby receiving and holding compartment. The left and right panels are then folded in toward each other over the lower section to form the bunting. Alternatively, the sections are folded to substantially overlie each other, and one of the panels is folded over several times to substantially overlie the other panel to form a compact bag.

5 Claims, 3 Drawing Sheets

COMBINATION BABY BLANKET, BUNTING AND BAG

BACKGROUND OF THE INVENTION

1. Field of the Invention

The present invention relates to a baby blanket or baby-changing blanket. More particularly, it relates to a baby blanket which is foldable to form a bunting and a bag.

2. Prior Art

The typical parent uses a large number and variety of products while caring for a baby and meeting its many needs. The need for so many products seriously cuts into the parents mobility and time. Taking the baby along on even the shortest journey or errand frequently requires assembling a large number of objects and loading them individually into the family car. Certain attempts have been made to provide more convenient baby accessories by combining two or three items into a single bag or blanket. An example of these prior art attempts can be seen in U.S. Pat. No. 4,125,903, U.S. Pat. No. 4,698,862 and U.S. Pat. No. 4,886,150. However, certain drawbacks still exist even with the large number of baby products currently available. More specifically, none of the prior art devices discloses a baby blanket which can be used as a changing cloth and which can be conveniently transported as bunting or carried separately as a bag.

SUMMARY OF THE INVENTION

It is therefore an object of the present invention to overcome the drawbacks of the prior art and to provide a baby blanket that is also useful as a changing cloth with the various changing supplies being conveniently stored and readily accessible.

It is a further object of the present invention to provide such a blanket which can be formed into a bunting to be carried with the baby.

It is yet another object of the present invention to provide a baby blanket which can be folded and conveniently carried as a bag.

These and other related objects are achieved according to the invention by a baby blanket which is foldable to form a bunting and a bag, including a soft cloth panel having a left edge and a spaced-opposite right edge. The cloth panel includes an upper, middle and lower section which each extend from the left edge to the right edge. The left panel is pivotally-connected to the left edge and the right panel is pivotally-connected to the right edge. The cloth panel is spread out with the left and right panels extending outwardly therefrom to form a large, soft baby blanket. The lower section is folded over the middle section to define the baby receiving and holding compartment therein with the left and right panels folded in toward each other over the lower section to form the bunting. The sections are folded to substantially overlie each other and one of the panels is folded over several times until it overlies the other of said panels to form a compact bag.

Left pocket means are formed on the left panel and right pocket means are formed on the right panel. Each pocket means comprises means for releasably securing the pocket means in a closed condition. The cloth panel is generally rectangular and includes an upper fold line disposed between the upper section and the middle section and a lower fold line disposed between the middle section and the lower section.

The fold lines are generally parallel to each other and generally perpendicular to the edges so that each section is generally rectangular, with the middle section and the lower section being approximately the same size. The panels are pivotally connected to respective edges of the middle section and the means for releasably securing the pocket means extends collinearly with the upper fold line. Each section and each panel has a height measured parallel to the edges and a width measured transverse to the edges. The middle and lower section and the panels all have approximately the same height. The panels each have a width approximately one-half the width of the middle section. The middle section includes a first half and a second half of approximately the same size divided along a center line extending between the upper fold line and the lower fold line, generally parallel to the edges.

The blanket includes a first handle attached to the middle section along the center line and each of the panels includes a connected end and a spaced-opposite free end. The blanket includes a second handle attached to one of the free ends defining a panel with a handle and a panel without a handle. The panel without a handle is folded in to substantially overlie the first half. The first half is subsequently folded over to substantially overlie the second half with the panel without a handle sandwiched therebetween. The panel with a handle is folded over to substantially overlie the first half and second half with the handles disposed together. The pocket means on the panel with a handle includes a sleeve having a closed end adjacent to the connected end and an open end adjacent to the free end. The open end of the sleeve remains accessible for removable storage and transportation when the blanket is folded up to form the bag.

The blanket further includes connecting means along the edges of the middle and lower sections for releasably connecting the edges of the middle section to the edges of the lower section upon folding the lower section over the middle section so that the baby receiving and holding compartment is securely formed.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
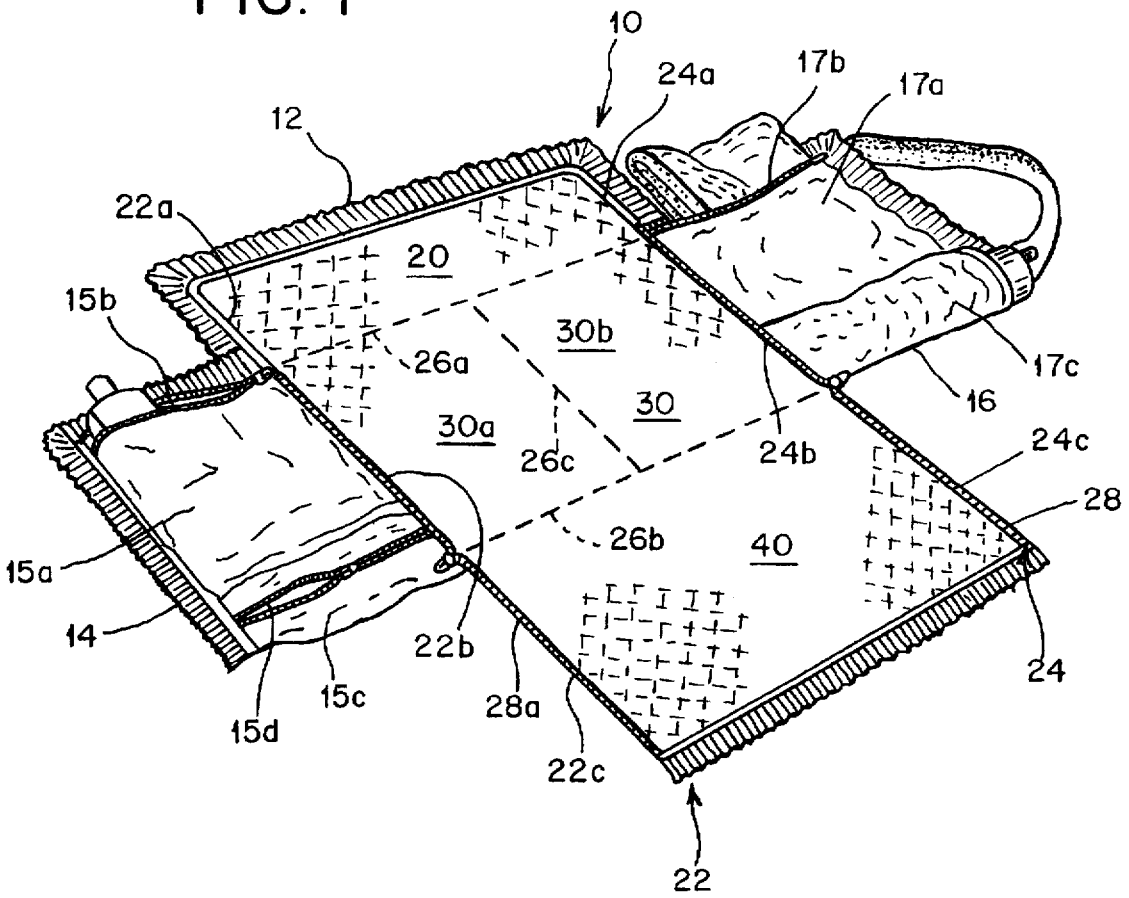
FIG. 1 is a perspective view of a baby blanket according to the invention, spread out for use as a changing cloth.

Referring now in detail to the figures and in particular FIG. 1, there is shown a baby blanket 10 which is spread out to be used as a changing cloth or simply a large, soft, clean surface for the baby to play on or sleep on or under. Baby blanket 10 may also serve as a liner, for example by placing it on a carriage or stroller seat. Baby blanket 10 includes a central, generally rectangular, soft cloth panel 12 having a left edge 22 consisting of edge portions 22*a*, 22*b* and 22*c*, and a right edge 24 consisting of edge portions 24*a*, 24*b* and 24*c*. Cloth panel 12 further includes an upper section 20, a middle section 30 and a lower section 40, which each extend from left edge 22 to right edge 24. Upper section 20 and middle section 30 are divided by an upper fold line 26*a*. Middle section 30 and lower section 40 are divided by a lower fold line 26*b*. Middle section 30 is further divided into a first half 30*a* and a second half 30*b*, separated by center line 26*c*. Edge portions 22*a*, 22*b*, 22*c*, 24*a*, 24*b*, 24*c* and center line 26*c* are all parallel to each other. Fold lines 26*a* and 26b are parallel to each other and transverse to center line 26*c*.

A left panel 14 is pivotally-connected along left edge 22 and a right panel 16 is pivotally-connected along right edge 24. For example, left panel 14 and right panel 16 are attached to edge portions 22*b* and 24*b*, respectively. Left panel 14 includes pockets 15*a* and 15*c* equipped with releasable securing means or devices 15*b* and 15*d*, respectively. The securing devices 15*b* and 15*d* are selected from hook and loop closure means, zipper closure means, snap closure means or any other suitable closure means. Right panel 16 includes a pocket 17*a* with a releasable closure device 17*b*. Right panel 16 also includes a sleeve 17*c* for storing additional items, as will be discussed in detail below. Panels 12, 14 and 16 may be constructed from a large variety of natural or synthetic materials, for example cotton. Pockets may be constructed from any fluid impervious material so that any baby accessories stored therein will be contained upon breaking. Ideally, the entire blanket is machine washable.

Figure 2:
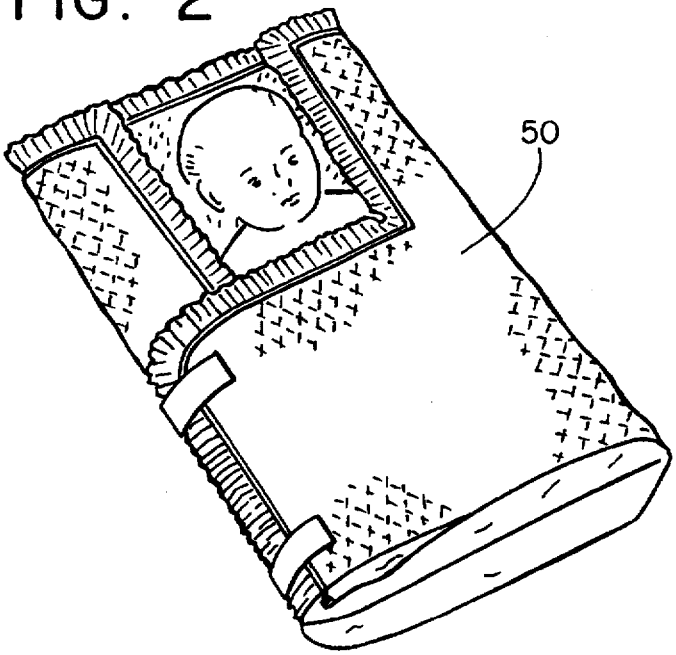
FIG. 2 is a perspective view of a baby blanket folded to form a bunting.

While changing the baby on cloth panel 12, closure means 15*b*, 15*d* and 17*b* provide ready access to various stored changing accessories. However, the closure means are oriented to avoid interference with the baby while retrieving or storing accessories, as well as being located far enough from the center of cloth panel 12 to prevent the child from grabbing items contained within the pockets. More specifically, closure means 15*b* and 17*b* extend collinearly with upper fold line 26*a*. To transport the baby in cooler weather, the baby is placed with its torso on middle section 30 and its head on upper section 20. Lower section 40 is then folded upwardly along lower fold line 26*b* to substantially overlie middle section 30. Connecting means 28*a* and 28*b*, extend along edge portion 22*b*/22*c* and 24*b*/24*c*, respectively, which comprises a hook-and-loop fastener, zipper or other suitable connecting means. The zipper, for example, is then drawn on up on either side from lower fold line 26*b* along edge portions 22*b* and 24*b* up to upper fold line 26*a*. Thereafter, the left and right thirds of the blanket, which include panels 14 and 16, are folded inwardly to form bunting 50 as can be seen in FIG. 2.

Figure 3:
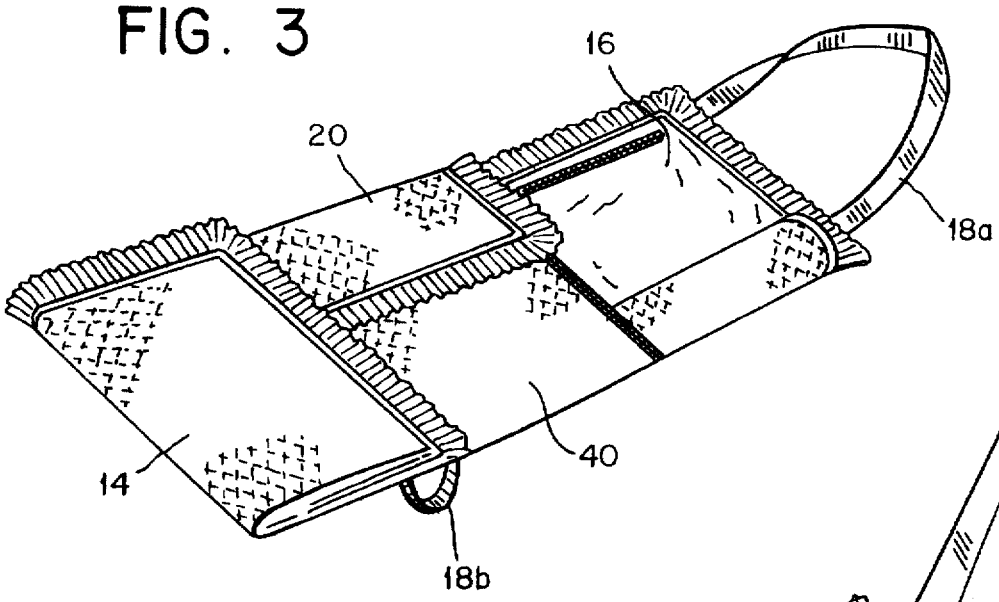
FIG. 3 is a perspective view showing the baby blanket partially folded.
Figure 4:
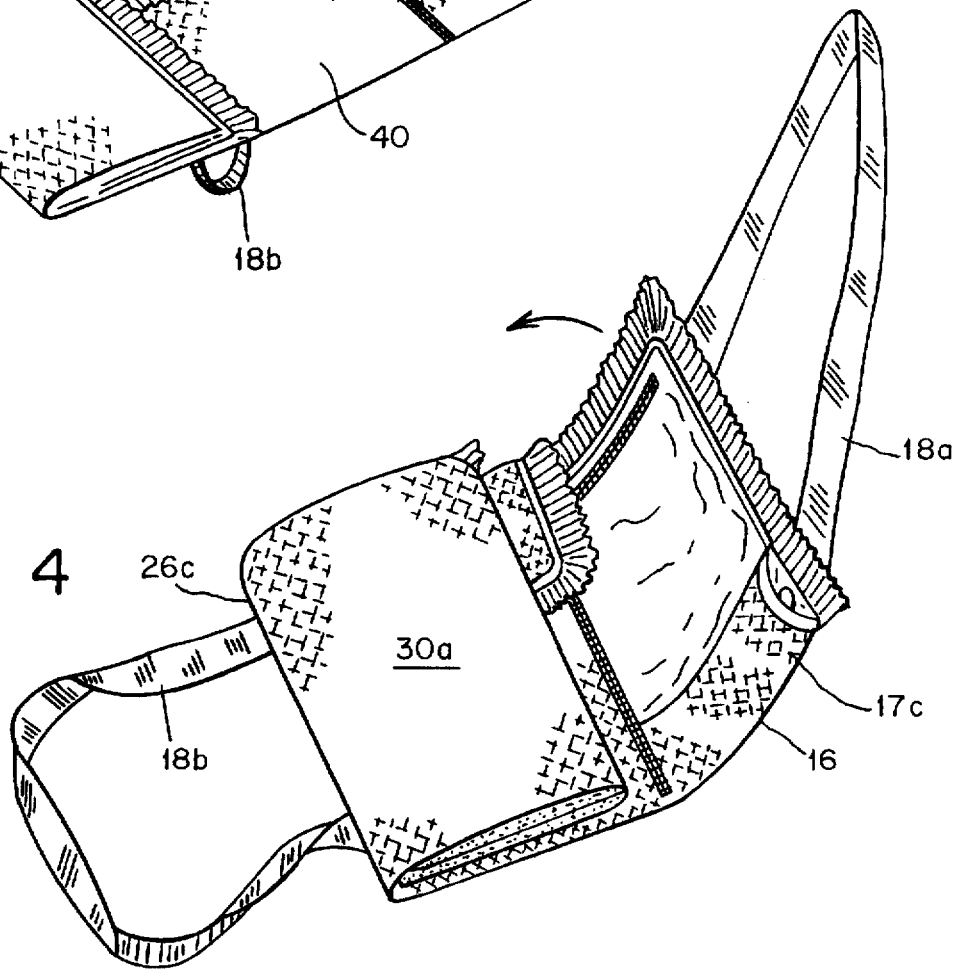
FIG. 4 is a perspective view showing the baby blanket further folded.
Figure 5:
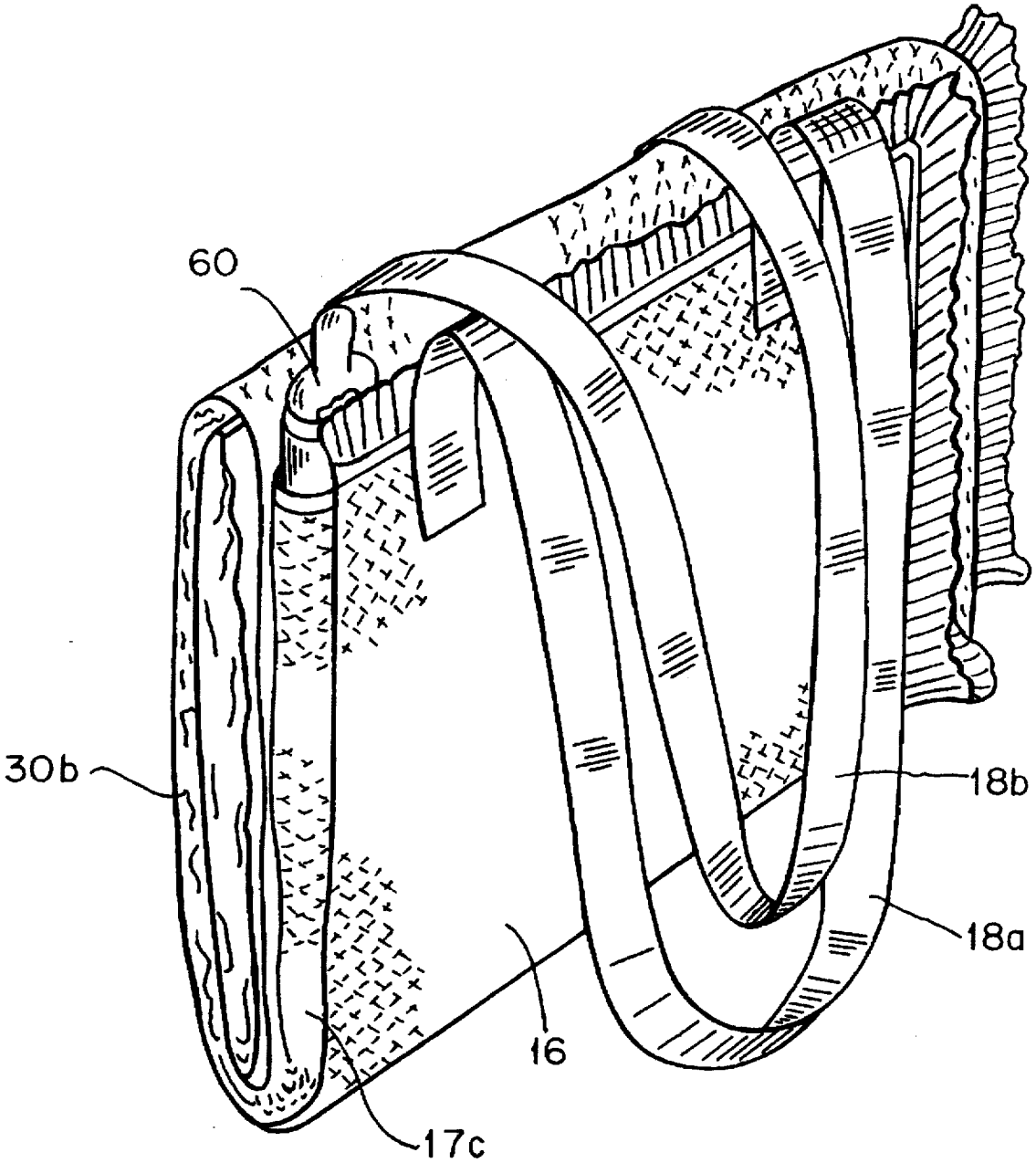
FIG. 5 is a perspective view showing the baby blanket completely folded into a bag.

FIGS. 3, 4 and 5 illustrate how baby blanket 10 can be folded into a bag for convenient carrying. Initially, upper section 20 is folded down and lower section 40 is folded up to substantially overlie middle section 30. Sections 20 and 40 may be folded in in any order. Left panel 14 is then folded along edge portion 22*b* to the right to overlie first half 30*a*. Left panel 14 and first half 30*a* are then folded along center line 26*c* to overlie second half 30*b*, as can be seen in FIG. 4. In this view, first handle 18*a* is visible, which is connected to the free end of right panel 16. In addition, sleeve 17 is visible with its open end facing first handle 18*a*. Second handle 18*b* is also visibly connected to the rear or outer portion of cloth panel 12 along center line 26*c*. The combined first half 30*a*, left panel 14 and second half 30*b* are then folded along edge portion 24*b* against right panel 16 with the resulting configuration shown in FIG. 5. Handles 18*a* and 18*b* are now closely positioned to be grasped by one hand. Sleeve 17*c* remains accessible so that the baby's bottle 60 or similar item is readily accessible.

Accordingly, while only a single embodiment of the present invention has been shown and described, it is obvious that many changes and modifications may be made thereunto without departing from the spirit and scope of the invention.

What is claimed is:

1. A foldable baby blanket, comprising:

(a) a soft cloth panel having a left edge and a spaced opposite right edge, said cloth panel including an upper section, a middle section and a lower section with each section extending from said left edge to said right edge, wherein said middle section includes a first half and a second half of approximately the same size divided along a center line;

(b) a left panel pivotally connected to the left edge and a right panel pivotally connected to the right edge, each of said panels having a connected end and a free end;

(c) left pocket means formed on said left panel and right pocket means formed on said right panel;

(d) means for releasably securing said pocket means in a closed condition, (e) a first handle attached to said middle section along said center line; and (f) a second handle attached to one of said free ends, defining a panel with a handle and a panel without a handle;

(g) connecting means disposed along the edges of the middle and lower sections for releasably connecting the edges of the middle section to corresponding edges of the lower section;

wherein said cloth panel is spread out with said left and right panels extending outwardly therefrom to form a large, soft baby blanket, wherein the panel without a handle may be folded over to substantially overlie the first half, the first half may be folded over to substantially overlie the second half with the panel without a handle sandwiched therebetween, and the panel with a handle may be folded over to substantially overlie the first half and the second half, with the handles disposed together to form a compact bag, and wherein the lower section is folded over the middle section with the left edges connected together and the right edges connected together by the connecting means, to define a securely-formed baby receiving and holding compartment lined with the soft cloth, with the left and right panels folded in toward each other over the lower section to form a bunting.

2. The baby blanket according to claim 1, wherein said cloth panel is generally rectangular and includes:

an upper fold line disposed between said upper section and said middle section and a lower fold line disposed between said middle section and said lower section;

wherein said fold lines are generally parallel to each other and generally perpendicular to said edges so that each section is generally rectangular with said middle section and said lower section being approximately the same size.

3. The baby blanket according to claim 1, wherein said panels are pivotally connected to respective edges of said middle section and said means for releasably securing said pocket means extends collinearly with said upper fold line.

4. The baby blanket according to claim 3, wherein each section and each panel has a height measured parallel to said edges and a width measured transverse to said edges;

wherein said middle section, said lower section and said panels all have approximately the same height;

wherein said panels each have a width approximately one-half the width of said middle section.

5. The baby blanket according to claim 1, wherein said pocket means on said panel with a handle includes a sleeve having a closed end adjacent the connected end and an open end adjacent said free end;

whereby said open end of said sleeve remains accessible for removable storage and transportation when said blanket is folded.

* * * * *